US006264166B1

(12) United States Patent
Bowland et al.

(10) Patent No.: US 6,264,166 B1
(45) Date of Patent: Jul. 24, 2001

(54) HANDS-FREE ACTIVATING VALVE FOR USE WITH LIQUID CONTAINERS

(76) Inventors: Mark A. Bowland, 1106 Mockingbird La., Fillmore, CA (US) 93015; Brian A. Bowland, 6520 Gazette Ave., Canoga Park, CA (US) 91306

( * ) Notice: Subject to any disclaimer, the term of this patent is extended or adjusted under 35 U.S.C. 154(b) by 0 days.

(21) Appl. No.: 09/801,123

(22) Filed: Mar. 5, 2001

(51) Int. Cl.[7] ..... B67D 5/34

(52) U.S. Cl. ..... 251/144; 251/340; 251/348; 220/714; 222/518

(58) Field of Search ..... 222/518, 511, 222/175, 610, 490; 251/336, 342, 339, 340, 341, 348, 349, 354, 144; 220/703, 714; 224/414, 148.2, 148.4

(56) References Cited

U.S. PATENT DOCUMENTS

| | | | | |
|---|---|---|---|---|
| D. 358,295 | | 5/1995 | Moench . | |
| 4,420,097 | * | 12/1983 | Motsenbocker | 222/175 X |
| 4,850,566 | * | 7/1989 | Riggert | 251/342 X |
| 4,913,401 | * | 4/1990 | Handke | 251/342 |
| 5,060,833 | * | 10/1991 | Edison et al. | 224/148.2 |
| 5,062,591 | * | 11/1991 | Runkel | 224/148.2 |
| 5,085,349 | | 2/1992 | Fawcett . | |
| 5,104,016 | * | 4/1992 | Runkel | 224/148.2 |
| 5,215,231 | * | 6/1993 | Paczonay | 222/610 |
| 5,601,207 | | 2/1997 | Paczonay . | |
| 5,607,087 | * | 3/1997 | Wery et al. | 222/610 |
| 5,699,933 | | 12/1997 | Ho et al. . | |
| 5,727,714 | * | 3/1998 | Fawcett | 222/175 |
| 5,730,336 | * | 3/1998 | Lerner | 222/490 |
| 5,791,510 | | 8/1998 | Paczonay . | |
| 5,806,726 | * | 9/1998 | Ho | 222/175 X |
| 5,816,457 | * | 10/1998 | Croft | 224/148.2 |
| 5,893,472 | | 4/1999 | Forrer . | |
| 5,911,406 | * | 6/1999 | Winefordner et al. | 251/339 |
| 5,913,456 | * | 6/1999 | Dikeman | 222/175 X |
| 5,924,678 | * | 7/1999 | Olde | 251/348 |
| 5,971,357 | * | 10/1999 | Denton et al. | 251/342 X |
| 6,032,831 | * | 3/2000 | Gardner et al. | 222/175 |
| 6,039,305 | * | 3/2000 | Hoskins et al. | 251/342 |
| 6,050,444 | * | 4/2000 | Sugg | 220/714 X |
| 6,070,767 | | 6/2000 | Gardner et al. . | |
| 6,199,729 | * | 3/2001 | Drzymkowski | 224/148.2 |

* cited by examiner

*Primary Examiner*—Kevin Shaver
*Assistant Examiner*—Eric Keasel
(74) *Attorney, Agent, or Firm*—Thomas I. Rozsa; Tony D. Chen; Jerry Fong

(57) ABSTRACT

A hands-free activating valve which permits liquid to flow and be ingested by the user. The apparatus includes a mouth portion and a mounting portion which engages to the opening of a container such as a water bottle. Embedded within the mouth portion is the hands-free activating valve which includes an elongated flexible arch shaped activating stem, where one end is fixed to a holding plate and the other end is attached to a valve. The activating stem has memory which allows the stem to return to its initial condition. The valve is seated on a valve seat of the mounting portion for blocking liquid from exiting the apparatus. In addition, there is also an elongated liquid channel which is located adjacent to the activating stem. This liquid channel extends from the holding plate to the valve and communicates to the outside for allowing the liquid to flow therethrough and be consumed by the user. To activate the hands-free activating valve, the user's front teeth are positioned on the arch of the activating stem, where the user's front teeth apply a downward force on the arch, thereby moving the valve inwardly to allow the valve to move away from the valve seat which in turn allows liquid to flow through the liquid channel to be sucked and consumed by the user.

25 Claims, 2 Drawing Sheets

HANDS-FREE ACTIVATING VALVE FOR USE WITH LIQUID CONTAINERS

BACKGROUND OF THE INVENTION

1. Field of the Invention

The present invention relates to the field of a liquid delivery device for delivering a liquid such as water to the mouth of someone who is unable to use his or her hands or alternatively is engaged in an activity such as bicycle riding where it is much more convenient to deliver the liquid through a method which does not require the cyclist to remove his or her hands from the handlebars.

2. Description of the Prior Art

In general, the present invention involves the concept of a valve through which liquid can be dispensed for drinking which does not require the user to use his or her hands to cause the liquid to flow into the user's mouth.

The following seven (7) prior art patents are found to be pertinent to the field of the present invention:

1. U.S. Pat. No. 5,085,349 issued to Fawcett on Feb. 4, 1992 for "Resilient Valve And Dispensing System For Bicyclists" (hereafter the "Fawcett Patent");
2. U.S. Pat. No. 5,601,207 issued to Paczonay on Feb. 11, 1997 for "Bite Valve Having A Plurality Of Slits" (hereafter "the '207 Paczonay Patent");
3. U.S. Pat. No. 5,699,933 issued to Ho et al on Dec. 23, 1997 for "Valve For A Water Dispenser For Bicyclists" (hereafter the "Ho Patent");
4. U.S. Pat. No. 5,791,510 issued to Paczonay on Aug. 11, 1998 for "Self Sealing Bite Valve" (hereafter "the '510 Paczonay Patent");
5. U.S. Pat. No. 5,893,472 issued to Forrer on Apr. 13, 1999 for "Spout For Valve Assembly" (hereafter the "Forrer Patent");
6. U.S. Pat. No. 6,070,767 issued to Gardner et al. on Jun. 6, 2000 for "Personal Hydration System With An Improved Mouthpiece" (hereafter the "Gardner Patent"); and
7. U.S. Pat. No. Des. 358,295 issued to Moench on May 16, 1995 for "Valve Coupling" (hereafter the "Moench Patent").

The Fawcett Patent discloses a resilient valve and dispensing system for bicyclists. The Fawcett Patent discusses the concept of a hands-free activating valve. The resilient valve is an elongated body that forms a hollow structure having an open inlet end opposed to a closed outlet end. A fluid supply chamber is formed between the inlet and outlet ends, and the open end is connected to the end of a length of tubing in order to supply fluid flow to the supply chamber, while the closed end provides a closure member that normally precludes fluid flow therethrough. The body member can be deformed to move the valve into the closure member, where the slit extends through the end wall and communicates the supply chamber with fluid whenever the slit is deformed into the opened position. The slit is biased into a closed position by the fluid pressure effected on the closure member together with the memory resilient body. A liquid supply is connected to the tubing and provides a fluid source for the supply chamber and when the valve body is deformed to open the slit, fluid flows from the supply chamber and away from the valve where the contents of the chamber are made available to be ingested by the person.

The '207 Paczonay Patent discloses a bit valve having a plurality of slits through which the liquid can be dispensed.

The Ho Patent discloses a valve for a water dispenser for bicyclists.

The '510 Paczonay Patent discloses a self sealing bite valve.

The Forrer Patent discloses a spout for a valve assembly.

The Gardner Patent discloses a personal hydration system with an improved mouthpiece.

The Moench Patent discloses a valve coupling.

While the prior art of record discloses the general concept of a hands-free activating valve for delivering liquid for ingestion by the user, the devices are not efficient and are subject to leak. It is therefore desirable to provide an efficient non-leaking hands-free activation valve for delivering liquid which may be ingested by a user.

SUMMARY OF THE INVENTION

The present invention relates generally to the field of valves and more particularly to a hands-free activating valve which permits liquid to flow and be ingested by the user.

The apparatus includes a mouth portion and a mounting portion which can be press-fitted or threadedly engaged to the opening of a container such as a water bottle. Embedded within the mouth portion is the hands-free activating valve which includes an elongated flexible arch shaped activating stem, where one end is fixed to a holding plate and the other end is attached to a valve. The activating stem is made of resilient plastic material that has memory which allowed the stem to return to its initial condition.

The valve is seated on a valve seat of the mounting portion for blocking liquid from exiting the apparatus. In addition, there is also provided an elongated liquid channel which is located adjacent to the activating stem. This liquid channel extends from the holding plate to the valve and communicates to the outside for allowing the liquid to flow therethrough and be consumed by the user.

To activate the hands-free activating valve, the user's front teeth are positioned on the arch of the activating stem, where the user's front teeth apply a downward force on the arch, thereby moving the valve inwardly to allow the valve to move away from the valve seat which in turn allows liquid to flow through the liquid channel to be sucked and consumed by the user. As the pressure from the bite is released on the arch of the activating stem, the valve is allowed to move back into the valve seat to block off the flow of liquid in the liquid channel.

It has been discovered, according to the present invention, that if a resilient plastic member is formed into an arch with one end of the member being held fixed and the other end of the resilient member attached to a valve which is forced against a valve seat, then a transverse force on the arch will cause the valve to move away from the valve seat.

It has further been discovered, according to the present invention, that if the resilient plastic member which is formed into an arch and is mounted on the opening of a liquid container such that one end of the resilient plastic member is fixed to a plate and the other end of the resilient plastic member is attached to a valve which is caused to move into a valve seat by the prestressed state of the resilient plastic member such that a transverse force on the arch shaped portion of the resilient plastic member such as a bite from teeth will cause the valve to move away from the valve seat and permit the liquid in the container to flow through the valve. It has further been discovered that if a liquid channel is connected from the valve seat to an opening, then upon the transverse force on the resilient plastic member being effected, the valve will open and permit the liquid to flow out of the opening to be ingested by a user. It is further discovered that upon the removal of the transverse force, the prestressed nature of the resilient plastic member will once again cause the valve to move back into the valve seat and shut off the flow of liquid.

It has also been discovered, according to the present invention, that with an arch shaped resilient member of sufficient memory, once the transverse force on the arch shaped member is removed, the resilient member under tension will always cause the valve to close and prevent leakage of fluid from the container.

It is therefore an object of the present invention to provide a resilient plastic member which is formed into an arch with one end of the member being held fixed and the other end of the resilient member attached to a valve which is forced against a valve seat, so that a transverse force on the arch will cause the valve to move away from the valve seat.

It is a further object of the present invention to provide a resilient plastic member which is formed into an arch which in turn is mounted on the opening of a liquid container such that one end of the resilient plastic member is fixed to a plate and the other end of the resilient plastic member is attached to a valve which is caused to move into a valve seat by the prestressed tension on the resilient plastic member such that a transverse force on the arch shaped portion of the resilient plastic member such as a bite from teeth will cause the valve to move away from the valve seat and permit the liquid in the container to flow through the valve. It is a further object of the present invention to provide a liquid channel connected from the valve seat to an opening, so that upon the transverse force on the resilient plastic member being effected, the valve will open and permit the liquid to flow out of the opening to be ingested by a user. It is further object of the present invention to provide a sufficiently resilient arch shaped member so that upon the removal of the transverse force, the prestressed tension on the resilient plastic member once again cause the valve to move back into the valve seat and shut off the flow of liquid.

It is an additional object of the present invention to provide an arch shaped resilient member of sufficient memory so that once the transverse force on the arch shaped member is removed, the resilient member under tension will always cause the valve to close and prevent leakage of fluid from the container.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
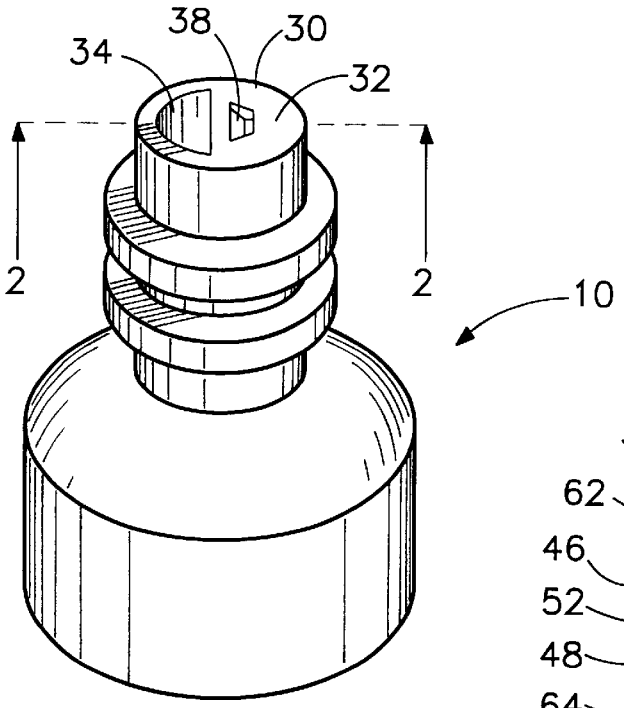
FIG. 1 is a perspective view of the mouth and mounting portion of the present invention which can be press-fitted onto the opening of a liquid container.
Figure 2:
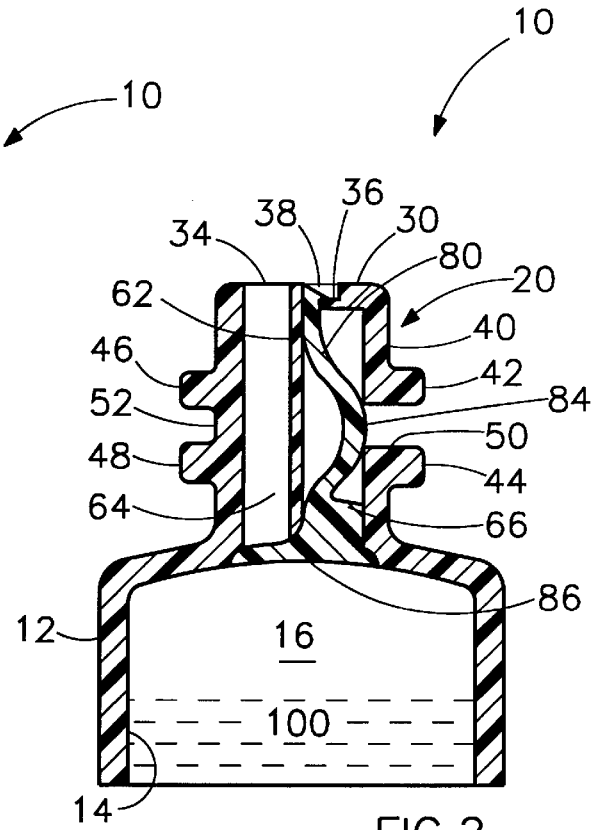
FIG. 2 is a cross-sectional view taken along line 2—2 of FIG. 1 showing the arch shaped resilient member in the closed position with the valve fitted into the valve seat thereby preventing liquid from flowing through a channel.
Figure 3:
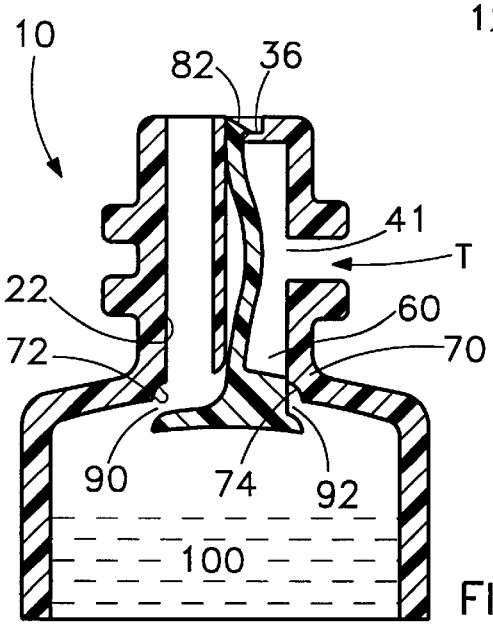
FIG. 3 is the cross-sectional view from FIG. 2 showing the arch shaped resilient member after a transverse force has been applied to it and the valve is moved away from the valve seat permitting liquid to flow through a channel.

Referring to FIGS. 1, 2 and 3, there is shown at 10 the present invention hands-free activated valve apparatus. The apparatus includes a lower sidewall 12 which surrounds an interior hollow chamber 16 into which a liquid 100 can flow. The first embodiment of the present invention apparatus 10 illustrated in FIGS. 1 through 3 is a press fit embodiment wherein sidewall 12 can be press fitted onto the opening of a container (not shown) by having the interior surface 14 of sidewall 12 press fit onto the exterior opening of a container for housing liquids. Alternatively, the interior surface of the sidewall 12 can be press fitted into the opening of the liquid container. By virtue of this press fit onto (or into) the container, the liquid 100 which by way of example can be water, juice, protein drink, etc. automatically flows from the container into the hollow chamber 16.

The apparatus 10 further comprises an upper neck portion 20 which comprises a top surface 30 and a neck sidewall 40. The neck sidewall 40 includes a first upper extension 42 and a spaced apart parallel second upper extension 44 with a space 50 between them. The opposite portion of the neck sidewall 40 includes a first lower extension 46 which is aligned with first upper extension 42 and a spaced apart parallel second lower extension 48 which is aligned with second upper extension 44. First lower extension 46 and second lower extension 48 are parallel to each other and spaced apart by a space 52 which is the same height and width as space 50. Spaces 50 and 52 are aligned with each other. The neck sidewall 40 surrounds an interior hollow chamber 60 which is longitudinally divided by longitudinal dividing wall 62 which divides interior hollow chamber 60 into a first longitudinal interior chamber 64 and a second longitudinal interior chamber 66, both of which extend for most of the length of neck portion 20 and both of which are in fluid engagement with hollow chamber 16.

Upper neck portion 20 and lower sidewall 12 join at a throat area 70. The interior sidewall 22 of upper neck portion 20 forms a valve seat 72 at the throat area 70.

Top surface 30 of upper neck portion 20 comprises a solid surface 32 through which a first opening 34 extends and is in fluid communication with first longitudinal interior chamber 64. The top surface 30 also comprises an interior ledge 36 which extends slightly below the surface level so as to create a gap 38 in top surface 30. Longitudinal dividing wall 62 is attached and in the preferred embodiment integrally formed with the interior of top surface 30, and extends the length of the interior portion of upper neck portion 20 and ends slightly above the valve seat 72.

A key point of novelty of the present invention is an arch shaped resilient member 80. At its top end, arch shaped resilient portion 80 has a hook member 82 by which it is snap fitted into he gap 38 and held in place against ledge 36, to thereby retain the arch shaped resilient member 80 within second interior longitudinal chamber 66. The arch shaped resilient member 80 is prestressed so that its arch portion 84 nearly abuts the interior wall 22 of upper neck portion 20 at the location of the space 50. Sidewall 40 contains a gap 41 at the location of space 50 so that arch shaped portion 84 fills the gap 41 and is accessible from space 50.

Arch shaped resilient member 80 terminates in a transverse valve member 86 which is caused to abut against the valve seat 72 to thereby seal off interior hollow chamber 60 from interior hollow chamber 16.

Therefore, in its prestressed memory condition, arch shaped resilient member 80 is affixed at one end adjacent top surface 30 and extends the length of upper neck portion 20 so that its transverse valve member 86 abuts against the valve seat 72 and its arch portion 84 is aligned with and abuts against gap 41 in sidewall 40 and is in contact with space 50. In this initial condition, the liquid 100 in the liquid container and which extends into interior chamber 16 is sealed off from neck interior chamber 60 of neck portion 20 and the assembly is in the closed condition. When a transverse force T is applied to the arch portion 84 in the direction of the arrow shown in FIG. 3, the arch portion 84 is caused to move away from the gap 41 in upper neck sidewall 40 and this in turn causes transverse valve member 86 to move away from the valve seat 72 as illustrated in FIG. 3, thereby opening a passageway 90 between transverse valve member 86 and valve seat 72 so that liquid can flow from chamber 16 through first longitudinal interior chamber 64 and out opening 34 in top surface 30.

For use by a person, space 50 is sized to accommodate the width of at least one human tooth (preferably a front upper tooth) and space 52 is sized to accommodate the width of at least one human tooth (preferably a front lower tooth). Therefore, when a biting action occurs such that opposite upper and lower teeth of a user are inserted into spaces 50 and 52 respectively, the transverse biting action causes arch portion 84 to move away from gap 41 and causes transverse valve member 86 to move away from the valve seat 72 so that liquid can flow from chamber 16 through passageway 90 through first longitudinal interior chamber 64 and out opening 34 so that the liquid can be ingested by the user. The transverse valve member 86 is configured such that when the valve member 86 is caused to move away from the valve seat 72, no gap is created on the area of the second longitudinal interior chamber 66 so that no liquid can flow in the second longitudinal interior chamber 66.

The arch shaped resilient member 80 has sufficient memory such that when the transverse force "T" is removed, the arch portion 84 returns to its location adjacent gap 41 and the transverse valve 86 returns to its initial position against the valve seat 72 to shut off the flow of liquid. Therefore, when the bite is completed and the teeth removed from spaces 50 and 52, the arch shaped resilient member 80 causes the valve to close.

Figure 4:
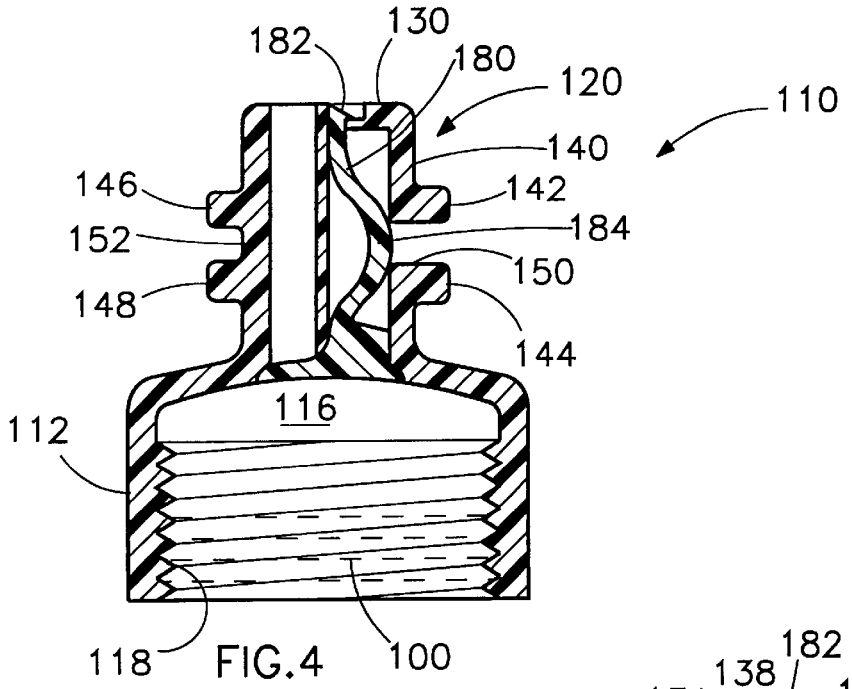
FIG. 4 is a cross-sectional view of an alternative embodiment of the present invention which can be threaded onto the opening of a liquid container, and showing the arch shaped resilient member in the closed position with the valve fitted into the valve seat thereby preventing liquid from flowing through a channel.
Figure 5:
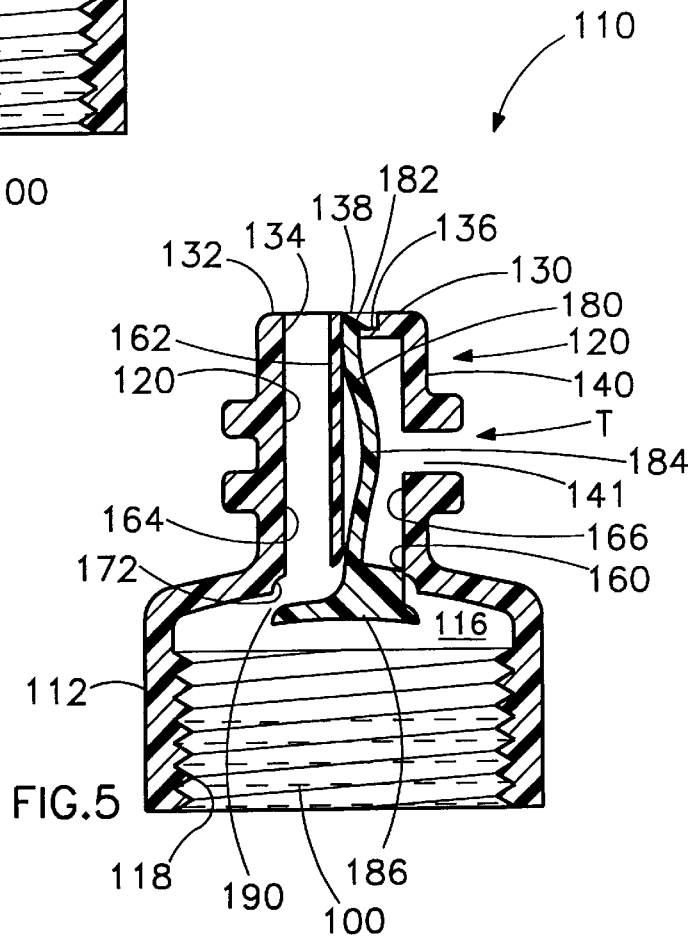
FIG. 5 is a cross-sectional view of the alternative embodiment of the present invention shown in FIG. 4, and showing the arch shaped resilient member after a transverse force has been applied to it and the valve is moved away from the valve seat permitting liquid to flow through a channel.

Illustrated in FIGS. 4 and 5 is an alternative embodiment of the present invention. The only difference in this alternative embodiment 110 is the method of attachment to a liquid container. The apparatus 110 includes a lower sidewall 112 which surrounds an interior hollow chamber 116 into which a liquid 100 can flow. The alternative embodiment of the present invention apparatus 110 illustrated in FIGS. 4 and 5 is a threaded fit embodiment wherein sidewall 112 contains internal threads 118 so that apparatus 110 can be threaded onto the exterior threads of the liquid container. By way of example, the apparatus 110 can be sized so that the threads 118 fit conventional threads of a soda bottle or water bottle. By virtue of this threaded fit embodiment wherein interior threads 118 of sidewall 12 can be threaded onto container, the liquid 100 which by way of example can be water, juice, protein drink, etc. automatically flows from the container into the hollow chamber 116.

The apparatus further comprises an upper neck portion 120 which comprises a top surface 130 and a neck sidewall 140. The neck sidewall 140 includes a first upper extension 142 and a spaced apart parallel second upper extension 144 with a space 150 between them. The opposite portion of the neck sidewall 140 includes a first lower extension 146 which is aligned with first upper extension 142 and a spaced apart parallel second lower extension 148 which is aligned with second upper extension 144. First lower extension 146 and second lower extension 148 are parallel to each other and spaced apart by a space 152 which is the same height and width as space 150. Spaces 150 and 152 are aligned with each other. The neck sidewall 140 surrounds an interior hollow chamber 160 which is longitudinally divided by longitudinal dividing wall 162 which divides interior hollow chamber 160 into a first longitudinal interior chamber 164 and a second longitudinal interior chamber 166, both of which extend for most of the length of neck portion 120 and both of which are in fluid engagement with hollow chamber 116.

Upper neck portion 120 and lower sidewall 112 join at a throat area 170. The interior sidewall 122 of upper neck portion 120 forms a valve seat 172 at the throat area 170.

Top surface 130 of upper neck portion 120 comprises a solid surface 132 through which a first opening 134 extends and is in fluid communication with first longitudinal interior chamber 164. The top surface 130 also comprises an interior ledge 136 which extends slightly below the surface level so as to create a gap 138 in top surface 130. Longitudinal dividing wall 162 is attached and in the preferred embodiment integrally formed with the interior of top surface 130, and extends the length of the interior portion of upper neck portion 120 and ends slightly above the valve seat 172.

A key point of novelty of the present invention is an arch shaped resilient member 180. At its top end, arch shaped resilient member 180 has a hook member 182 by which it is snap fitted into the gap 138 and held in place against ledge 136, to thereby retain the arch shaped resilient member 180 within second interior longitudinal chamber 166. The arch shaped resilient member 180 is prestressed so that its arch portion 184 is located adjacent to the interior wall 122 of upper neck portion 120 at the location of the space 150. Sidewall 140 contains a gap 141 at the location of space 150 so that arch shaped portion 184 fills the gap 141 and is accessible from space 150.

Arch shaped resilient member 180 terminates in a transverse valve member 186 which is caused to abut against the value seat 172 to thereby seal off interior hollow chamber 160 from interior hollow chamber 116.

Therefore, in its prestressed memory condition, arch shaped resilient member 180 is affixed at one end adjacent top surface 130 and extends the length of upper neck portion 120 so that its transverse valve member 186 abuts against the valve seat 172 and its arch portion 184 is aligned with and abuts against gap 141 in sidewall 140 and is in contact with space 150. In this initial condition, the liquid 100 in the liquid container and which extends into hollow chamber 116 is sealed off from hollow chamber 160 of neck portion 120 and the assembly is in the closed condition. When a transverse force "T" is applied to the arch portion 184 in the direction of the arrow shown in FIG. 5, the arch portion 184 is caused to move away from the gap 141 in upper neck sidewall 140 and this in turn causes transverse valve member 186 to move away from the valve seat 172 as illustrated in FIG. 5, thereby opening a passageway 190 between transverse valve member 186 and valve seat 172 so that liquid can flow from chamber 116 through first longitudinal interior chamber 164 and out opening 134 in top surface 130.

The present invention conforms to conventional forms of manufacture or any other conventional way known to one skilled in the art. The apparatus can be made from several materials. By way of example, the apparatus can be made of polypropylene material while the arch shaped resilient member can be made of nylon material.

Defined in detail, the present invention is a valve apparatus, comprising: (a) a lower sidewall which surrounds an interior hollow chamber into which a liquid can flow; (b) means for attaching the lower sidewall to an opening of a liquid container such that liquid can flow from the container into the interior hollow chamber; (c) an upper neck portion having a top surface and a neck sidewall; (d) the neck sidewall including a first upper extension and a spaced apart parallel second upper extension extending parallel to the first upper extension and separated therefrom by a first space; (e) the neck sidewall further including a gap at the location of the first space; (f) the neck sidewall further including a first lower extension opposite the location of the first upper extension, the first lower extension aligned with the first upper extension; (g) the neck sidewall further including a second lower extension opposite the location of the second upper extension, the second lower extension aligned with the second upper extension; (h) the first lower extension and the second lower extension being parallel to each other and separated by a second space; (i) the neck sidewall surrounding an interior hollow chamber which is longitudinally divided by a longitudinal dividing wall extending from the top surface and dividing the interior hollow chamber into a first longitudinal interior chamber and a second longitudinal interior chamber, both chambers being in fluid engagement with the interior hollow chamber surrounded by the lower sidewall; (j) the upper neck portion and the lower sidewall portion joined at a throat area having an interior sidewall which forms a valve seat; (k) the top surface including a solid surface through which a first opening extends and which is in fluid communication with the first longitudinal interior chamber, the top surface also including an interior ledge which extends slightly below the top surface level so as to create a gap in the top surface which is aligned with the second longitudinal interior chamber; (l) the longitudinal dividing wall extending from the top surface through most of the length of the upper neck portion to a location adjacent the valve seat; (m) an arch shaped resilient member having a hook at one end which is snap fitted into the gap in the top surface and held in place against the ledge to thereby retain the arch shaped resilient member within the second longitudinal interior chamber; (n) the arch shaped resilient member prestressed so that its arch portion is located adjacent to the interior wall of the upper neck portion at the location of the gap in the neck sidewall such that the arch portion is accessible from the first space; (o) the arch shaped resilient member terminating in a transverse valve member which is caused to abut against the valve seat to thereby seal off the first and second interior longitudinal chambers from the interior hollow chamber in the lower sidewall; and (p) the arch shaped resilient member having a sufficient memory so that when a transverse force is applied at the location of the arch portion, the arch shaped resilient member is caused to move away from the gap in the neck sidewall and move toward the dividing wall which in turn causes the transverse valve to move away from the valve seat to thereby permit liquid to pass from the hollow chamber in the lower sidewall through the first longitudinal interior chamber and through the opening in the top surface, and when the transverse force is removed, the arch portion returns to the gap in the neck sidewall and the transverse valve returns to abut against the valve seat to seal off the first and second interior longitudinal chambers.

Defined broadly, the present invention is a valve apparatus, comprising: (a) a lower sidewall which surrounds an interior hollow chamber into which a liquid can flow; (b) means for attaching the lower sidewall to an opening of a liquid container such that liquid can flow from the container into the interior hollow chamber; (c) an upper neck portion having a top surface and a neck sidewall, the neck sidewall having a gap located adjacent to means on the neck sidewall to receive at least one tooth; (d) the neck sidewall surrounding an interior hollow chamber which is longitudinally divided by a longitudinal dividing wall attached to the top surface and extending from the top surface and dividing the interior hollow chamber into a first longitudinal interior chamber and a second longitudinal interior chamber, both chambers being in fluid engagement with the interior hollow chamber surrounded by the lower sidewall; (e) the upper neck portion and the lower sidewall joined at a throat area having an interior sidewall which forms a valve seat; (f) the top surface including a solid surface through which a first opening extends and which is in fluid communication with the first longitudinal interior chamber; (g) the dividing wall extending from the top surface through most of the length of the upper neck portion to a location adjacent the valve seat; (h) an arch shaped resilient member having means at one end to attach it to a location on the top surface so that it is retained within the interior chamber of the upper neck portion; (i) the arch shaped resilient member prestressed so that its arch portion is adjacent to the interior wall of the upper neck portion at the location of the gap in the upper neck sidewall such that the arch portion is accessible when a tooth is pressed against the gap in the neck sidewall; (j) the arch shaped resilient member terminating in a transverse valve member which is caused to abut against the valve seat to thereby seal off the first and second longitudinal interior chambers from the interior hollow chamber in the lower sidewall; and (k) the arch shaped resilient member having a sufficient memory so that when a transverse force from a tooth is applied at the location of the arch portion, the arch shaped resilient member is caused to move away from the gap in the neck sidewall and move toward the dividing wall which in turn causes the transverse valve member to move away from the valve seat to thereby permit liquid to pass from the hollow chamber in the lower sidewall through the first longitudinal interior chamber and through the opening in the top surface, and when the transverse force is removed, the arch portion returns to the gap in the neck sidewall and the transverse valve member returns to abut against the valve seat to seal off the first and second longitudinal chambers.

Defined more broadly, the present invention is a valve apparatus, comprising: (a) a lower sidewall which surrounds an interior hollow chamber into which a liquid can flow; (b) means for attaching the lower sidewall to an opening of a liquid container such that liquid can flow from the container into the interior hollow chamber; (c) an upper neck portion having a top surface and a neck sidewall, the neck sidewall having a gap located adjacent to means on the neck sidewall to receive at least one tooth; (d) the neck sidewall surrounding at least one interior longitudinal chamber which is in fluid engagement with the interior hollow chamber surrounded by the lower sidewall; (e) the upper neck portion and the lower sidewall joined at a throat area having an interior sidewall which forms a valve seat; (f) the top surface including a solid surface through which a first opening extends and which is in fluid communication with the at least one interior longitudinal chamber; (g) an arch shaped resilient member having means at one end to attach it to a location on the top surface so that it is retained within the at least one interior longitudinal chamber; (h) the arch shaped resilient member prestressed so that its arch portion is adjacent to the interior wall of the upper neck portion at the location of the gap in the neck sidewall such that the arch portion is accessible when the at least one tooth is pressed against the gap in the neck sidewall; (i) the arch shaped resilient member terminating in a transverse valve member which is caused to abut against the valve seat to thereby seal off the at least one interior longitudinal chamber from the interior hollow chamber in the lower sidewall; and (j) the arch shaped resilient member having a sufficient memory so that when a transverse force from the at last one tooth is applied at the location of the arch portion, the arch shaped resilient member is caused to move away from the gap in the neck sidewall which in turn causes the transverse valve member to move away from the valve seat to thereby permit liquid to pass from the hollow chamber in the lower sidewall through the at least one interior longitudinal chamber and through the opening in the top surface, and when the transverse force is removed, the arch portion returns to the gap in the neck sidewall and the transverse valve member returns to abut against the valve seat to seal off the at least one interior longitudinal chamber.

Defined even more broadly, the present invention is a valve apparatus comprising: (a) a container having a hollow elongated neck portion with a top having an opening leading to an interior chamber of the elongated neck portion, and which the elongated neck portion includes an interior wall and an exterior sidewall having a gap therein located adjacent to means on the sidewall to receive at least one tooth; (b) the container further including a lower portion having means by which the container is attached to a source of liquid; (c) the container having a hollow interior further including a valve seat; (d) an arch shaped resilient member having means at one end by which it is retained in the elongated neck portion of the container, the arch shaped resilient member prestressed so that its arch portion is adjacent to the interior wall of the elongated neck portion at the location of the gap such that the arch portion is accessible when the at least one tooth is pressed against the gap; (e) the arch shaped resilient member terminating in a transverse valve member which is caused to abut against the valve seat to thereby seal off the interior chamber in the elongated neck portion from the portion of the container by which it is attached to the source of liquid; and (f) the arch shaped resilient member having a sufficient memory so that when a transverse force from the at least one tooth is applied at the location of the arch portion, the arch shaped resilient member is caused to move away from the gap which in turn causes the transverse valve member to move away from the valve seat to thereby permit liquid to pass from the source of liquid through the interior chamber in the elongated neck portion and through the opening in the top surface, and when the transverse force is removed, the arch portion returns to the gap and the transverse valve member returns to abut against the valve seat to seal off the interior chamber in the elongated neck portion.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A valve apparatus, comprising:

a. a lower sidewall which surrounds an interior hollow chamber into which a liquid can flow;

b. means for attaching said lower sidewall to an opening of a liquid container such that liquid can flow from the container into said interior hollow chamber;

c. an upper neck portion having a top surface and a neck sidewall;

d. said neck sidewall including a first upper extension and a spaced apart parallel second upper extension extending parallel to said first upper extension and separated therefrom by a first space;

e. said neck sidewall further including a gap at the location of said first space;

f. said neck sidewall further including a first lower extension opposite the location of the first upper extension, the first lower extension aligned with the first upper extension;

g. said neck sidewall further including a second lower extension opposite the location of the second upper extension, the second lower extension aligned with the second upper extension;

h. said first lower extension and said second lower extension being parallel to each other and separated by a second space;

i. said neck sidewall surrounding an interior hollow chamber which is longitudinally divided by a longitudinal dividing wall extending from said top surface and dividing the interior hollow chamber into a first longitudinal interior chamber and a second longitudinal interior chamber, both chambers being in fluid engagement with the interior hollow chamber surrounded by said lower sidewall;

j. said upper neck portion and said lower sidewall portion joined at a throat area having an interior sidewall which forms a valve seat;

k. said top surface including a solid surface through which a first opening extends and which is in fluid communication with the first longitudinal interior chamber, the top surface also including an interior ledge which extends slightly below the top surface level so as to create a gap in the top surface which is aligned with the second longitudinal interior chamber;

l. said longitudinal dividing wall extending from the top surface through most of the length of the upper neck portion to a location adjacent said valve seat;

m. an arch shaped resilient member having a hook at one end which is snap fitted into the gap in the top surface and held in place against said ledge to thereby retain the arch shaped resilient member within said second longitudinal interior chamber;

n. said arch shaped resilient member prestressed so that its arch portion is located adjacent to the interior wall of the upper neck portion at the location of the gap in said neck sidewall such that the arch portion is accessible from said first space;

o. said arch shaped resilient member terminating in a transverse valve member which is caused to abut against said valve seat to thereby seal off the first and second interior longitudinal chambers from the interior hollow chamber in the lower sidewall; and p. said arch shaped resilient member having a sufficient memory so that when a transverse force is applied at the location of said arch portion, the arch shaped resilient member is caused to move away from said gap in the neck sidewall and move toward said dividing wall which in turn causes said transverse valve to move away from said valve seat to thereby permit liquid to pass from the hollow chamber in the lower sidewall through said first longitudinal interior chamber and through said opening in said top surface, and when said transverse force is removed, said arch portion returns to said gap in said neck sidewall and said transverse valve returns to abut against said valve seat to seal off the first and second interior longitudinal chambers.

2. The valve apparatus in accordance with claim 1 wherein said first space is of sufficient width to accommodate the width of at least one upper human tooth and said second space is of sufficient width to accommodate the width of at least one lower human tooth and said transverse force is created by a biting action of at least two oppositely disposed teeth wherein one tooth comes in contact with said arch portion to cause it to move away from said gap in said neck sidewall and open said transverse valve member.

3. The valve apparatus in accordance with claim 1 wherein said arch shaped resilient member is made of plastic material.

4. The valve apparatus in accordance with claim 1 wherein said arch shaped resilient member is made of nylon.

5. The valve apparatus in accordance with claim 1 wherein said upper neck portion, said lower sidewall, said top, said ledge, said longitudinal dividing wall, said first upper extension, said first second upper extension, said first lower extension and said second lower extension are all molded as a unitary member.

6. The valve apparatus in accordance with claim 1 wherein said means for attaching said lower sidewall to the opening of the liquid container is a press fit on an interior surface of the lower sidewall onto the opening of the liquid container.

7. The valve apparatus in accordance with claim 1 wherein said means for attaching said lower sidewall to the opening of the liquid container are threads on an interior surface of said lower sidewall so that the lower sidewall can be threaded onto mating threads on the opening of the liquid container.

8. A valve apparatus, comprising:

a. a lower sidewall which surrounds an interior hollow chamber into which a liquid can flow;

b. means for attaching said lower sidewall to an opening of a liquid container such that liquid can flow from the container into said interior hollow chamber;

c. an upper neck portion having a top surface and a neck sidewall, the neck sidewall having a gap located adjacent to means on said neck sidewall to receive at least one tooth;

d. said neck sidewall surrounding an interior hollow chamber which is longitudinally divided by a longitudinal dividing wall attached to said top surface and extending from said top surface and dividing the interior hollow chamber into a first longitudinal interior chamber and a second longitudinal interior chamber, both chambers being in fluid engagement with the interior hollow chamber surrounded by said lower sidewall;

e. said upper neck portion and said lower sidewall joined at a throat area having an interior sidewall which forms a valve seat;

f. said top surface including a solid surface through which a first opening extends and which is in fluid communication with the first longitudinal interior chamber;

g. said dividing wall extending from the top surface through most of the length of the upper neck portion to a location adjacent said valve seat;

h. an arch shaped resilient member having means at one end to attach it to a location on said top surface so that it is retained within said interior chamber of said upper neck portion;

i. said arch shaped resilient member prestressed so that its arch portion is adjacent to the interior wall of the upper neck portion at the location of the gap in said upper neck sidewall such that the arch portion is accessible when a tooth is pressed against said gap in the neck sidewall;

j. said arch shaped resilient member terminating in a transverse valve member which is caused to abut against said valve seat to thereby seal off the first and second longitudinal interior chambers from the interior hollow chamber in the lower sidewall; and k. said arch shaped resilient member having a sufficient memory so that when a transverse force from a tooth is applied at the location of said arch portion, the arch shaped resilient member is caused to move away from said gap in the neck sidewall and move toward said dividing wall which in turn causes said transverse valve member to move away from said valve seat to thereby permit liquid to pass from the hollow chamber in the lower sidewall through said first longitudinal interior chamber and through said opening in said top surface, and when said transverse force is removed, said arch portion returns to said gap in said neck sidewall and said transverse valve member returns to abut against said valve seat to seal off the first and second longitudinal chambers.

9. The valve apparatus in accordance with claim 8 wherein said arch shaped resilient member is made of plastic material.

10. The valve apparatus in accordance with claim 8 wherein said arch shaped resilient member is made of nylon.

11. The valve apparatus in accordance with claim 8 wherein said upper neck portion, said lower sidewall, said top, said ledge, said interior dividing wall, said first upper extension, said first second upper extension, said first lower extension and said second lower extension are all molded as a unitary member.

12. The valve apparatus in accordance with claim 8 wherein said means for attaching said lower sidewall to the opening of the liquid container is a press fit on an interior surface of the lower sidewall onto the opening of the liquid container.

13. The valve apparatus in accordance with claim 8 wherein said means for attaching said lower sidewall to the opening of the liquid container are threads on an interior surface of said lower sidewall so that the lower sidewall can be threaded onto mating threads on the opening of the liquid container.

14. A valve apparatus, comprising:

a. a lower sidewall which surrounds an interior hollow chamber into which a liquid can flow;

b. means for attaching said lower sidewall to an opening of a liquid container such that liquid can flow from the container into said interior hollow chamber;

c. an upper neck portion having a top surface and a neck sidewall, the neck sidewall having a gap located adjacent to means on said neck sidewall to receive at least one tooth;

d. said neck sidewall surrounding at least one interior longitudinal chamber which is in fluid engagement with the interior hollow chamber surrounded by said lower sidewall;

e. said upper neck portion and said lower sidewall joined at a throat area having an interior sidewall which forms a valve seat;

f. said top surface including a solid surface through which a first opening extends and which is in fluid communication with said at least one interior longitudinal chamber;

g. an arch shaped resilient member having means at one end to attach it to a location on said top surface so that it is retained within said at least one interior longitudinal chamber;

h. said arch shaped resilient member prestressed so that its arch portion is adjacent to the interior wall of the upper neck portion at the location of the gap in said neck sidewall such that the arch portion is accessible when the at least one tooth is pressed against said gap in the neck sidewall;

i. said arch shaped resilient member terminating in a transverse valve member which is caused to abut against said valve seat to thereby seal off the at least one interior longitudinal chamber from the interior hollow chamber in the lower sidewall; and j. said arch shaped resilient member having a sufficient memory so that when a transverse force from the at last one tooth is applied at the location of said arch portion, the arch shaped resilient member is caused to move away from said gap in the neck sidewall which in turn causes said transverse valve member to move away from said valve seat to thereby permit liquid to pass from the hollow chamber in the lower sidewall through said at least one interior longitudinal chamber and through said opening in said top surface, and when said transverse force is removed, said arch portion returns to said gap in said neck sidewall and said transverse valve member returns to abut against said valve seat to seal off the at least one interior longitudinal chamber.

15. The valve apparatus in accordance with claim 14 wherein said arch shaped resilient member is made of plastic material.

16. The valve apparatus in accordance with claim 14 wherein said arch shaped resilient member is made of nylon.

17. The valve apparatus in accordance with claim 14 wherein said upper neck portion, said lower sidewall, said top, said means to receive the at least one tooth, and said valve seat are all molded as a unitary member.

18. The valve apparatus in accordance with claim 14 wherein said means for attaching said lower sidewall to the opening of the liquid container is a press fit on an interior surface of the lower sidewall onto the opening of the liquid container.

19. The valve apparatus in accordance with claim 14 wherein said means for attaching said lower sidewall to the opening of the liquid container are threads on an interior surface of said lower sidewall so that the lower sidewall can be threaded onto mating threads on the opening of the liquid container.

20. A valve apparatus comprising:

a. a container having a hollow elongated neck portion with a top having an opening leading to an interior chamber of the elongated neck portion, and which the elongated neck portion includes an interior wall and an exterior sidewall having a gap therein located adjacent to means on said sidewall to receive at least one tooth;

b. said container further including a lower portion having means by which the container is attached to a source of liquid;

c. said container having a hollow interior further including a valve seat;

d. an arch shaped resilient member having means at one end by which it is retained in the elongated neck portion of the container, the arch shaped resilient member prestressed so that its arch portion is adjacent to the interior wall of the elongated neck portion at the location of the gap such that the arch portion is accessible when the at least one tooth is pressed against said gap; p1 e. said arch shaped resilient member terminating in a transverse valve member which is caused to abut against said valve seat to thereby seal off the interior chamber in the elongated neck portion from the portion of the container by which it is attached to the source of liquid; and f. said arch shaped resilient member having a sufficient memory so that when a transverse force from the at least one tooth is applied at the location of said arch portion, the arch shaped resilient member is caused to move away from said gap which in turn causes said transverse valve member to move away from said valve seat to thereby permit liquid to pass from the source of liquid through the interior chamber in the elongated neck portion and through said opening in said top surface, and when said transverse force is removed, said arch portion returns to said gap and said transverse valve member returns to abut against said valve seat to seal off the interior chamber in the elongated neck portion.

21. The valve apparatus in accordance with claim 20 wherein said arch shaped resilient member is made of plastic material.

22. The valve apparatus in accordance with claim 20 wherein said arch shaped resilient member is made of nylon.

23. The valve apparatus in accordance with claim 20 wherein said elongated hollow neck portion, said lower portion, said top, said means to receive at least one tooth, and said valve seat are all molded as a unitary member.

24. The valve apparatus in accordance with claim 20 wherein said means for attaching said apparatus to the source of liquid is a press fitted on the lower portion onto an opening of the source of liquid.

25. The valve apparatus in accordance with claim 20 wherein said means for attaching said apparatus to the source of liquid is internal threads on said lower portion so that the lower portion can be threaded onto mating threads on the opening of the source of liquid.

* * * * *